US007868289B2

(12) United States Patent
Cousins et al.

(10) Patent No.: US 7,868,289 B2
(45) Date of Patent: Jan. 11, 2011

(54) MASS SPECTROMETER ION GUIDE PROVIDING AXIAL FIELD, AND METHOD

(75) Inventors: Lisa Cousins, Woodbridge (CA); Gholamreza Javahery, Kettleby (CA); Ilia Tomski, Concord (CA)

(73) Assignee: Ionics Mass Spectrometry Group Inc., Bolton (CA)

( * ) Notice: Subject to any disclaimer, the term of this patent is extended or adjusted under 35 U.S.C. 154(b) by 680 days.

(21) Appl. No.: 11/742,203

(22) Filed: Apr. 30, 2007

(65) Prior Publication Data

US 2008/0265154 A1 Oct. 30, 2008

(51) Int. Cl.
*H01J 49/42* (2006.01)

(52) U.S. Cl. ..... 250/292; 250/281; 250/282; 250/396 R; 250/423 R; 250/424

(58) Field of Classification Search ..... 250/292, 250/396 R
See application file for complete search history.

(56) References Cited

U.S. PATENT DOCUMENTS

| | | | | |
|---|---|---|---|---|
| 4,023,398 | A | 5/1977 | French et al. | |
| 4,234,791 | A | 11/1980 | Enke et al. | |
| 4,531,056 | A | 7/1985 | Labowsky et al. | |
| 4,842,701 | A | 6/1989 | Smith et al. | |
| 4,861,988 | A | 8/1989 | Henion et al. | |
| 4,885,076 | A | 12/1989 | Smith et al. | |
| 4,963,736 | A | 10/1990 | Douglas et al. | |
| 4,977,320 | A | 12/1990 | Chowdhury et al. | |
| 5,015,845 | A | 5/1991 | Allen et al. | |
| 5,103,093 | A | 4/1992 | Sakairi et al. | |
| 5,171,990 | A | 12/1992 | Mylchreest et al. | |
| 5,248,875 | A | 9/1993 | Douglas et al. | |
| 5,352,892 | A | 10/1994 | Mordehai et al. | |
| 5,412,208 | A | 5/1995 | Covey et al. | |
| 5,521,382 | A | 5/1996 | Tanaka et al. | |
| 5,756,994 | A | 5/1998 | Bajic | |
| 5,847,386 | A * | 12/1998 | Thomson et al. | 250/288 |
| 6,107,628 | A | 8/2000 | Smith et al. | |
| 6,111,250 | A | 8/2000 | Thomson et al. | |

(Continued)

FOREIGN PATENT DOCUMENTS

| | | |
|---|---|---|
| GB | 2 324 906 | 4/1998 |

OTHER PUBLICATIONS

Dawson, P.H., ed., "Quadrupole Mass Spectrometry and its Applications", 1976, pp. 1-63, Elsevier Scientific Publishing, Amsterdam.

(Continued)

*Primary Examiner*—Nikita Wells
*Assistant Examiner*—Johnnie L Smith

(57) ABSTRACT

An ion guide includes a plurality of rods, arranged about an axis that extends lengthwise from one end to the other of the guide. The rods guide ions in a guide region along and about the axis. A conductive casing surrounds the rods. The casing and the rods are geometrically arranged to produce an axial electric field along the axis. Specifically, the geometry is such that a first constant applied DC voltage ($U_{DC}$), applied to the rods, and a second constant applied DC voltage ($U_{CASE}$) applied to the casing, produce a voltage gradient between said casing and said axis that has a different magnitude at different positions along said axis.

25 Claims, 11 Drawing Sheets

U.S. PATENT DOCUMENTS

| | | | | |
|---|---|---|---|---|
| 6,124,675 | A | 9/2000 | Bertrand et al. | |
| 6,462,336 | B1 | 10/2002 | Bajic | |
| 6,462,338 | B1 | 10/2002 | Inatsugu et al. | |
| 6,674,071 | B2 * | 1/2004 | Franzen et al. | 250/292 |
| 6,700,119 | B1 | 3/2004 | Giles | |
| 6,707,037 | B2 | 3/2004 | Whitehouse | |
| 6,730,904 | B1 | 5/2004 | Wells | |
| 6,744,043 | B2 | 6/2004 | Loboda | |
| 6,753,523 | B1 | 6/2004 | Whitehouse et al. | |
| 6,872,938 | B2 | 3/2005 | Makarov et al. | |
| 6,914,241 | B2 | 7/2005 | Giles et al. | |
| 7,064,322 | B2 * | 6/2006 | Crawford et al. | 250/290 |
| 7,164,125 | B2 * | 1/2007 | Weiss et al. | 250/292 |
| 7,507,955 | B2 * | 3/2009 | Crawford et al. | 250/292 |
| 7,564,025 | B2 * | 7/2009 | Crawford | 250/282 |
| 2003/0136905 | A1 * | 7/2003 | Franzen et al. | 250/292 |
| 2003/0222213 | A1 | 12/2003 | Taniguchi | |
| 2004/0011956 | A1 * | 1/2004 | Londry et al. | 250/292 |
| 2005/0274887 | A1 * | 12/2005 | Weiss et al. | 250/292 |
| 2007/0164213 | A1 | 7/2007 | Javahery et al. | |
| 2008/0203287 | A1 * | 8/2008 | Crawford | 250/282 |

OTHER PUBLICATIONS

McFarland, M.A. et al., "Ion 'Threshing': Collisionally Activated Dissociation in an External Octopole Ion Trap by Oscillation of an Axial Electric Potential Gradient", Analytical Chemistry, 2004, pp. 1545-1549, vol. 76.

Javahery, G. and B. Thomson, "A Segmented Radiofrequency-Only Quadrupole Collision Cell for Measurements of Ion Collision Cross Section on a Triple Quadrupole Mass Spectrometer", J. Am. Soc. Mass. Spectrom., 1997, pp. 697-702, vol. 8.

March, Raymond E. and John F. Todd, eds., "Practical Aspects of Ion Trap Mass Spectrometry, vol. 1: Fundamentals of Ion Trap Mass Spectrometry", 1995, pp. 10, 210-213, CRC Press, Inc.

March, Raymond E. and John F. Todd, eds., "Practical Aspects of Ion Trap Mass Spectrometry, vol. 2: Ion Trap Instrumentation", 1995, pp. 90-95, CRC Press, Inc.

Ashcroft, Alison E., "Ionization Methods in Organic Mass Spectrometry", The Royal Society of Chemistry Analytical Spectroscopy Monographs, 1997, pp. 20-26, 61-65, 74-83, 98-106, 122-127, 132-139, The Royal Society of Chemistry, Cambridge, UK.

Dehmelt, H.G., "Radiofrequency Spectroscopy of Stored Ions I: Storage", Advances in Atomic Physics 3, 1967, pp. 53-72.

Zubarev, Roman A. et al., "Electron Capture Dissociation of Multiply Charged Protein Cations. A Nonergodic Process", American Chemical Society, 1998, pp. 3265-3266, vol. 120.

Gerlich, Dieter, "Inhomogeneous RF Fields: A Versatile Tool for the Study of Processes with Slow Ions", Advances in Chemical Physics, 1992, pp. 1-176, vol. 82, Johny Wiley & Sons, Ltd.

Mason, Edward A. and Earl W. McDaniel, "Transport Properties of Ions in Gases", 1988, pp. 11-27, 468-479, John Wiley & Sons, Inc., New York.

Herron, William J. et al., "Reactions of Polyatomic Dianions with Cations in the Paul Trap", Rapid Commun. Mass Spectrometry, 1996, pp. 277-281, vol. 10, John Wiley & Sons, Ltd.

Cole, Richard B. ed., "Electrospray Ionization Mass Spectrometry: Fundamentals, Instrumentation and Applications", May 1997, pp. 179-196, 204-230, 244-250, John Wiley & Sons, Ltd.

International Search Report for International Patent Application No. PCT/CA2007/000049, filed Jan. 11, 2007.

Lee, E.D. and J.D. Henion, "Thermally Assisted Electrospray Interface for Liquid Chromatography/Mass Spectrometry", Rapid Communication in Mass Spectrometry, 1992, pp. 727-733, vol. 6.

International Search Report for International Patent Application No. PCT/CA2008/000776, filed Apr. 24, 2008.

* cited by examiner

MASS SPECTROMETER ION GUIDE PROVIDING AXIAL FIELD, AND METHOD

FIELD OF THE INVENTION

The present invention relates generally to mass spectrometry, and more particularly to ion guide in mass spectrometry, and associated methods. Ion guides exemplary of the invention are particularly well suited for use as collision cells.

BACKGROUND OF THE INVENTION

Mass spectrometry has proven to be an effective analytical technique for identifying unknown compounds and for determining the precise mass of known compounds. Advantageously, compounds can be detected or analysed in minute quantities allowing compounds to be identified at very low concentrations in chemically complex mixtures. Not surprisingly, mass spectrometry has found practical application in medicine, pharmacology, food sciences, semi-conductor manufacturing, environmental sciences, security, and many other fields.

A typical mass spectrometer includes an ion source that ionizes particles of interest. The ions are passed to an analyser region, where they are separated according to their mass (m)-to-charge (z) ratios (m/z). The separated ions are detected at a detector. A signal from the detector may be sent to a computing or similar device where the m/z ratios may be stored together with their relative abundance for presentation in the format of a m/z spectrum. Mass spectrometers are discussed generally in P. H. Dawson, Quadrupole Mass Spectrometry, 1976, Elsevier Scientific Publishing, Amsterdam.

An ion guide guides ionized particles between the ion source and the analyser/detector. The primary role of the ion guide is to transport the ions toward the low pressure analyser region of the spectrometer. Many known mass spectrometers produce ionized particles at high pressure, and require multiple stages of pumping with multiple pressure regions in order to reduce the pressure of the analyser region in a cost-effective manner. Typically, an associated ion guide transports ions through these various pressure regions.

A collision cell is a particular form of an ion guide that forms part of the analyser region, to improve the analysis of a sample. Collision cells fragment "parent" or precursor ions as a result of energetic collisions. They consist of a pressurized container (such as a ceramic or metal cylinder); gas (typically $N_2$ or Ar, pressurized from 0.1 to 10 mTorr); and the ion guide.

Ions may be fragmented when they are accelerated into the pressurized gas with sufficient kinetic energy. The collision cell must effectively capture these fragment ions, contain them along an axis, and transport them to the exit of the collision cell. A collision cell should guide and capture fragment ions and transports them with high efficiency.

Most ion guides and collision cells include parallel ion guide rods, often arranged in sets of two, three or four rod pairs. RF voltages of opposite phases are applied to opposing pairs of the rods to generate an electric field that contains the ions as they are transported in a gaseous medium from the entrance to the exit. An axial field may be used to accelerate ions within the ion guide, for example for fragmentation, and then to move ions along from the entrance to the exit. The axial field is significant as ions tend to slow down almost to a halt without it.

The axial field may, for example, be produced by manipulating the shape of the field produced by the parallel rods. The relative voltages on the neighboring rods determine the axial field. Unfortunately, ion guides that rely on the shape of the electric field between the rods to produce an axial field tend to distort the electric field asymmetrically, reducing mass range and sensitivity.

Other known ion guides use auxiliary electrodes in conjunction with the guide rods to produce an axial electric field. A DC voltage is applied to the auxiliary electrodes that, in conjunction with the rod set, serve to produce an axial field.

Unfortunately, the use of auxiliary electrodes tends to be complex and expensive. For example, for 2n guide rods in the ion guide, there will be 2n auxiliary rods, giving a total of 4n rods, increasing cost and complexity substantially.

Accordingly, there remains a need for a low cost and low complexity ion guide and collision cell that provides an axial field.

SUMMARY OF THE INVENTION

In accordance with an aspect of the present invention, there is provided an ion guide comprising: a plurality of rods, arranged in multipole about an axis that extends lengthwise from a first end to a second end of the ion guide, to guide ions in a guide region along and about the axis. Each of the plurality of rods is closer to the axis proximate the first end of the ion guide than the axis proximate the second end of the ion guide; a conductive casing surrounding the plurality of rods; at least one voltage source, interconnected to the plurality of rods and to the casing to produce a voltage gradient between the casing and the axis, the voltage gradient having a different magnitude at different positions along the axis to produce an axial electric field along the axis.

In accordance with another aspect of the present invention, there is provided an ion guide. The ion guide comprises: a plurality of rods, arranged about an axis that extends lengthwise from a first end to a second end of the ion guide, to guide ions in a guide region along and about the axis; a conductive casing surrounding the plurality of rods. The casing and the plurality of rods are geometrically arranged so that a first constant applied DC voltage ($U_{DC}$) applied to the rods, and a second constant applied DC voltage ($U_{CASE}$) applied to the conductive casing, produce a voltage gradient between the casing and the axis that has a different magnitude at different positions along the axis, to produce an axial electric field along the axis.

In accordance with yet another aspect of the present invention there is provided a method comprising: providing a plurality of rods about an axis that extends lengthwise from a first end to a second end to guide ions in a guide region along and about the axis; providing a conductive casing surrounding the plurality of rods, creating a multipolar electric field between the plurality of rods to contain ions in the guide region, applying a substantially DC voltage to the conductive casing and the rods. The casing and the plurality of rods are geometrically arranged so that the substantially DC voltage to the casing and the rods, produce a voltage gradient between the casing and the axis that has a different magnitude at different positions along the axis, to produce an axial electric field along the axis.

Conveniently, the ion guide may be used as a collision cell, or may alternatively transport ions through various pressure regions in a mass spectrometer Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
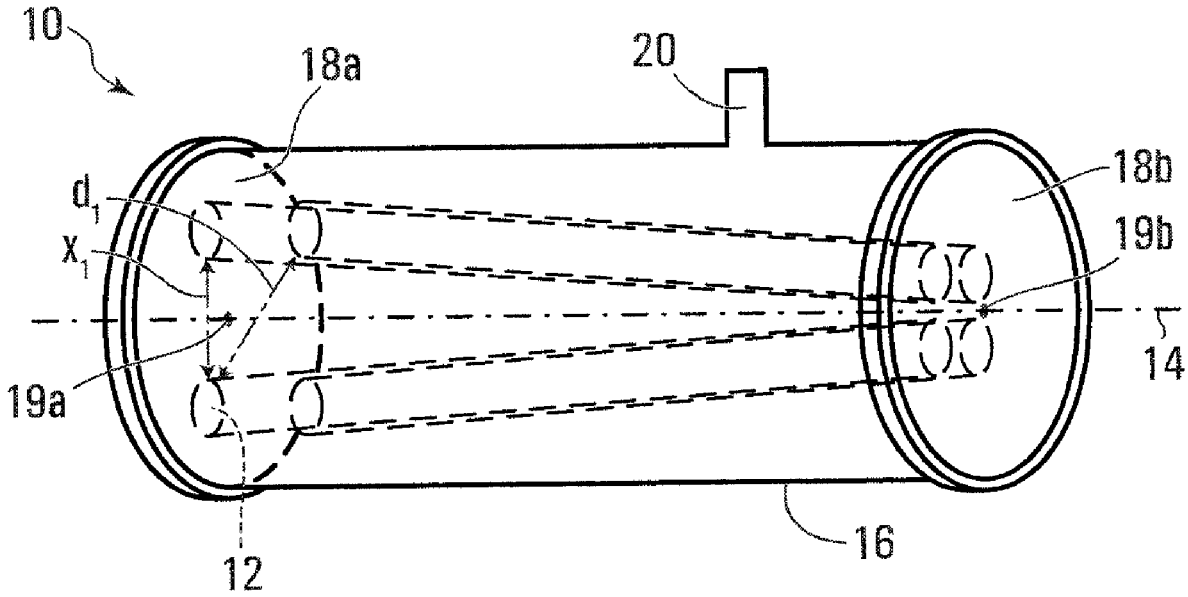
FIG. 1 is a three-dimensional schematic view of an ion guide, exemplary of an embodiment of the present invention.
Figure 2A:
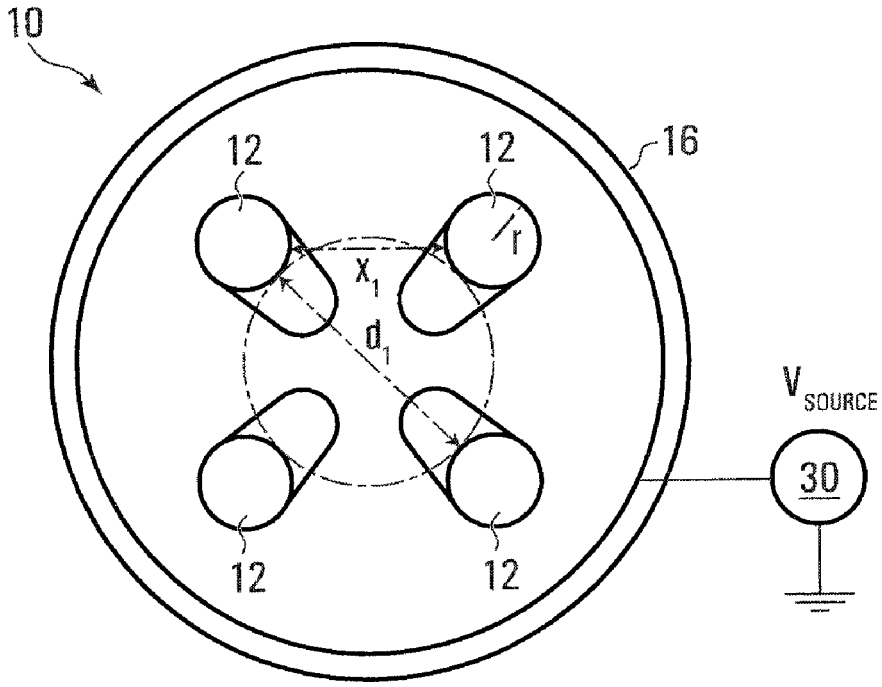
FIGS. 2A and 2B are cross-sectional views of the ion guide of FIG. 1.
Figure 2B:
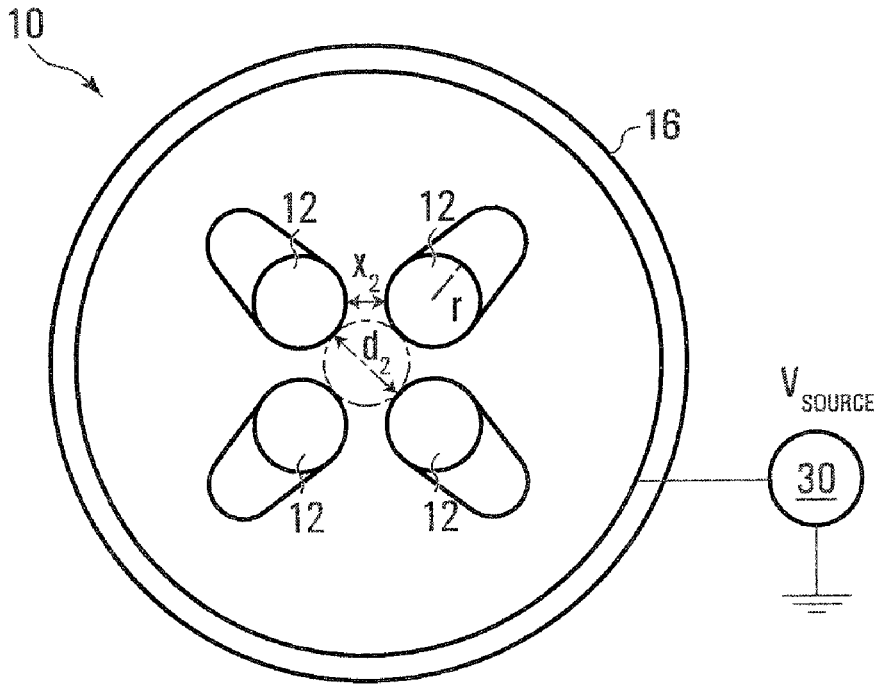

FIGS. 1, 2A and 2B depict an ion guide 10, exemplary of an embodiment of the present invention. As illustrated, ion guide 10 includes a plurality of rods 12, arranged about a central axis 14. A conductive casing 16 encases rods 12. In the depicted embodiment ion guide 10 is formed of four rods 12 that are identical, and tilted toward axis 14, as illustrated in FIG. 1.

As will become apparent, the configuration of ion guide 10 yields an electric field along axis 14. As such, ion guide 10 may be useful in mass spectrometers, as a non-fragmenting, pressurized ion guide or as a collision cell. Conveniently, the resulting axial fields may effectively sweep ions out of ion guide 10. If ions and gas are admitted into one end of ion guide 10, casing 16 may serve to restrict conductance, and decrease the pressure gradient as the ions are entrained in a gas flow. As will be appreciated, the pressure within the interior of ion guide 10 may be maintained by one or pumps (not shown) in direct or indirect flow communication with the interior of ion guide 10. Ion guide 10 further includes optional end plates 18*a* and 18*b*. By so enclosing casing 16, ion guide 10 may also effectively serve as a collision cell.

As detailed below, ion guide 10 acting as a collision cell may be maintained at a pressure in the order of 10-4 to 10-1 Torr. Ion guide 10 may alternatively transport ions through various pressure regions in a mass spectrometer at higher pressures. These pressure regions conventionally range from several Torr (typically 2 Torr, but as high as 10 Torr) to about 10-3 Torr. Conveniently, ion guide 10 may thus be used to restrict pumping between two or more vacuum chambers of a mass spectrometer. For example, ion guide 10 may replace a conventional aperture to provide a differential pressure between two vacuum chambers of a mass spectrometer, yielding higher transmission efficiency of the ions as they are moved through the various pressure regions.

In the depicted embodiment of FIG. 1, casing 16 is cylindrical with a diameter D and a length L usually longer than the projection of rods 12, along axis 14. Axis 14 extends from a first end of ion guide 10 to a second opposite end of ion guide 10. Example casing 16 may be formed with an inner surface formed of a conductive or partially conductive material, such as stainless steel, metallically plated ceramic, metallically plated semiconductor, or the like. End plates 18*a* and 18*b* may similarly be constructed of a conductive or partially conductive material. End plates 18*a* and 18*b* may be electrically isolated from casing 16. End plates 18*a*, 18*b* further include openings (referred to as apertures) 19*a* and 19*b*. Apertures 19*a* and 19*b* may act as inlets and outlets for ions to be guided or fragmented between rods 12.

Rods 12 may have any suitable length. For example, rods 12 may have a length of between about 5 and 400 mm, and typically between 150 and 200 mm, and a suitable diameter, typically 5 mm to 15 mm. In the depicted embodiment, rods 12 extend substantially along the length of ion guide 10. Rods 12, however, could be rod segments of a segmented rod set.

Rods 12 are positioned so that the distance x between opposing rods varies along the length of axis 14. In example ion guide 10, the cross-section of each of rods 12 does not change. That is, each of rods 12 has a uniform circular cross-section. Each rod 12 is simply tilted at an angle $\alpha$ relative to axis 14. For example rods 12 may be tilted by about 0.5-5° toward axis 14.

Again, at least the outer surface of rods 12 is constructed of a conductive or partially conductive material, such as stainless steel, metallically plated ceramic, metallically plated semiconductor.

Insulation of end plates 18*a* and 18*b* from casing 16 may, for example, be achieved by an annular insulating ring, between plates 18*a*, 18*b* and casing 16. As such, a voltage distinct from any voltage applied to casing 16 may be applied to plates 18*a*, 18*b*. This aids in the focusing and extraction of ions through apertures 19*a* and 19*b*.

Casing 16 contains gas about rods 12, effectively allowing ion guide 10 to function as a collision cell. Gas enters the region encased by casing 16 and plates 18*a* and 18*b* through a gas inlet 20 and escapes through apertures 19*a* and 19*b* on either end. Typical gas pressures are in the range of $10^{-4}$ to $10^{-2}$ Torr, usually composed of $N_2$ or Ar. Of course, other gases such as Xe, $NO_2$, reactive gases, or other suitable gases known to those of ordinary skill may be used. Other ways of containing gas about rods 12 will be appreciated to those of ordinary skill. For example, in place of end plates 18*a* and 18*b*, gas may be contained using conductance limited tubes, RF plates or rods, or the like.

Rods 12 are arranged at equal spacing about a circumscribed circle of diameter d, about axis 14, as illustrated in FIGS. 2A and 2B. The diameter of the circle varies along the length of axis 14, from a maximum diameter $d_1$ proximate aperture 19*a* (at lens 18*a*) to ion guide 10 as illustrated in FIG. 2A, to a minimum diameter $d_2$ proximate the aperture 19*b* (at lens 18*b*), as illustrated in FIG. 2B. Opposing rods are thus separated from each other by $d_2$ proximate aperture 19*b*, and $d_1$ proximate aperture 19*a*. Neighbouring rods are separated by $x_2$ and $x_1$ proximate apertures 19*b*, 19*a*, respectively, with $d_1>d_2$ and $x_1>x_2$.

Figure 3:
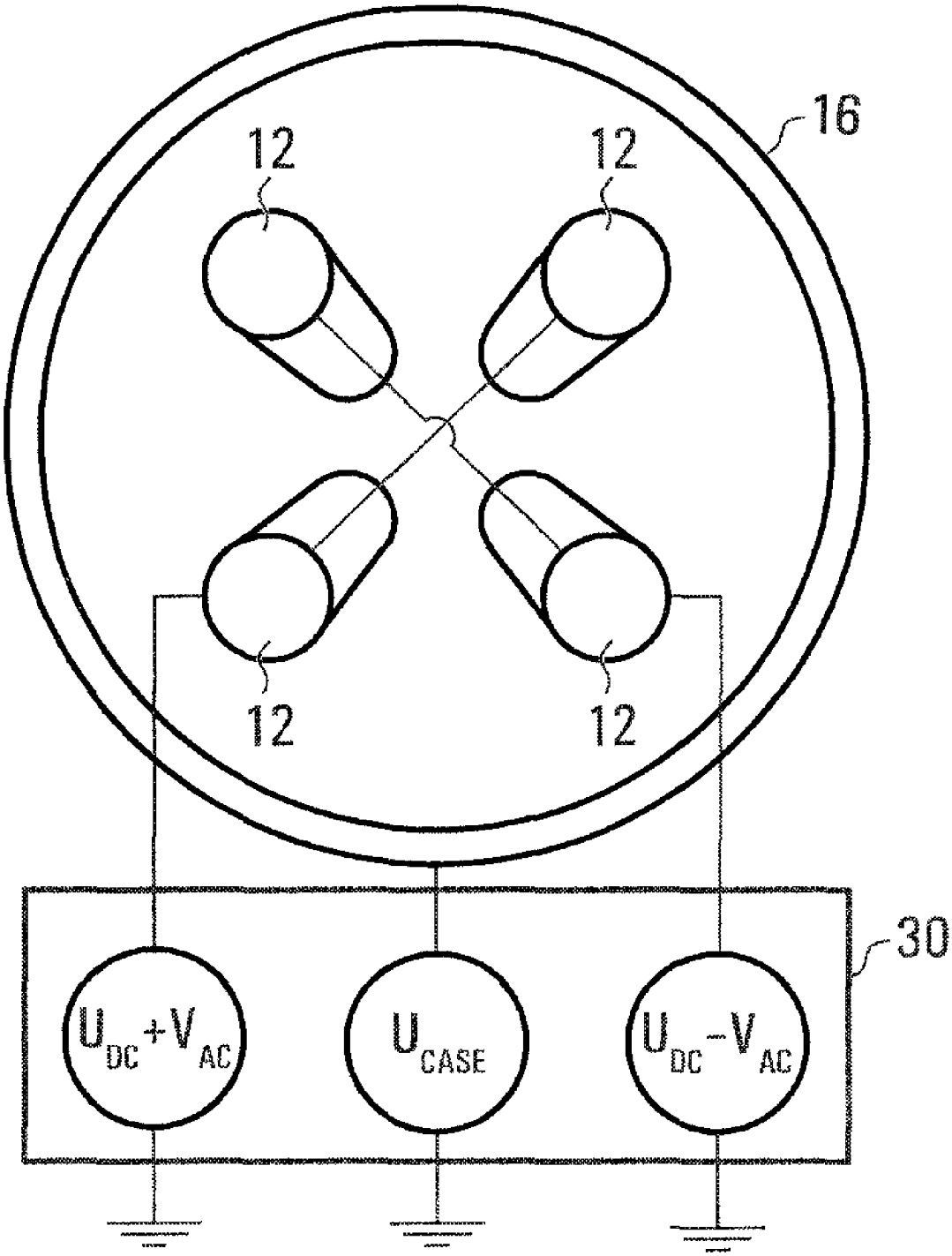
FIG. 3 is a schematic diagram illustrating voltages applied to rods in the ion guide of FIG. 1.

Now, a voltage source 30, places a static DC voltage on plates 18*a* and 18*b*, that act as lenses ($U_{lens1}$ and $U_{lens2}$), and on casing 16 ($U_{CASE}$). The combination of a static DC, $U_{DC}$, and AC voltage $V=V_0 \cos \Omega t$ is further applied to rods 12, as illustrated in FIG. 3. Voltage source 30 may be a single voltage source, or multiple independent voltage sources used to provide the desired AC and DC voltages.

Specifically, a static DC ($U_{DC}$) and an alternating RF ($V_{AC}$) are applied as shown, with neighboring rods 12 having the same $U_{DC}$ but opposite polarity $V_{AC}$ (i.e. 180° out of phase). Applied RF voltages to rods 12, as for conventional rod-sets, create a multipolar field used for ion containment to contain ions in a guide region about axis 14. In conventional applications the applied DC voltage, $U_{DC}$, provides a rod offset voltage that sets a nearly uniform reference voltage about axis 14 for contained ions. Here, however, voltage $U_{DC}$ combines with voltage $U_{CASE}$ to produce a voltage gradient that extends from casing 16 to axis 14, to provide a reference voltage $V_{AXIS}$ that varies along axis 14.

The relative contributions from the voltages on rods 12 and casing 16 to $V_{AXIS}$ will depend on the overall geometry of ion guide 10, including spacing x, casing diameter D, the rod diameter, and the applied voltages $U_{DC}$ and $U_{CASE}$. Specifically, because the spacing $x_i$ between rods 12 varies along length of guide 10, the relative contribution of $U_{CASE}$ and $U_{DC}$ will also vary along axis 14, resulting in a voltage gradient between the casing 16 and the rods 12 that varies in magnitude along the length, producing an axial electric field along axis 14. For constant $U_{DC}$ and $U_{CASE}$ (as is typical), as spacing x of rods decreases the contribution $U_{CASE}$ decreases.

The direction of the electric field along axis 14 will depend on $U_{DC}$ and $U_{CASE}$ applied to rods 12 and casing 16. If the voltage applied to casing 16, $U_{CASE}$, is more negative than $U_{DC}$, the voltage difference on axis 14 will be more negative at aperture 19*a* than at aperture 19*b*. Conversely, if the voltage applied to the casing is less negative than the voltage applied to rods 12, an axial field will result along axis 14 resulting from the more positive voltage difference between aperture 19*a* and aperture 19*b*. Depending on the direction of the axial field and the polarity of the ions to be guided, aperture 19*a* may act as inlet or outlet, and aperture 19*b* may act as outlet or inlet.

Conveniently, for a cylindrical casing 16, and cylindrical rods 12, and constant $U_{CASE}$ and $U_{DC}$, the magnitude of the axial field along axis 14 varies in dependence on the tilt of rods 12, their spacing from axis 14 and casing 12. The electric field in the region contained by rods 12 is the superposition of the RF containment field, and the axial field. Of course, a component of the field attributable to the potential applied to end plates 18*a*, 18*b*, may further act along axis 14, but is not discussed herein.

For pressures in the 10-3 Torr range, typical useful axial voltage gradients may be of the order of 0.5 V to several V across a several hundred mm length, resulting in an axial field having a magnitude of between about 0.25-3 mV/mm. For higher pressures, where the collision frequency is greater, more axial field strength may be required to sweep ions from guide 10.

Of note, with $d_1>d_2$, and suitable applied voltages, ions may conveniently be collected with large angular velocity or large radial dispersion at aperture 19*a*, acting as inlet, improving ion transmission from aperture 19*a* to 19*b*.

As will further be appreciated, an ion's initial kinetic energy near the inlet to ion guide 10 is determined by the potential difference on axis 14 near the inlet and the ion's initial voltage. The ion will then undergo collisions with the contained gas whereby the kinetic energy is transferred into internal energy. If the energy and gas density is sufficient, the ion will undergo fragmentation. Fragment ions will be accelerated by the axial field along axis 14. Notably, the ion's kinetic energy will not further increase by its charge because of collisions. The ion will, however, pick up on average a small portion of the energy. The corresponding velocity is considered the "drift velocity" of the ion.

Figure 4A:
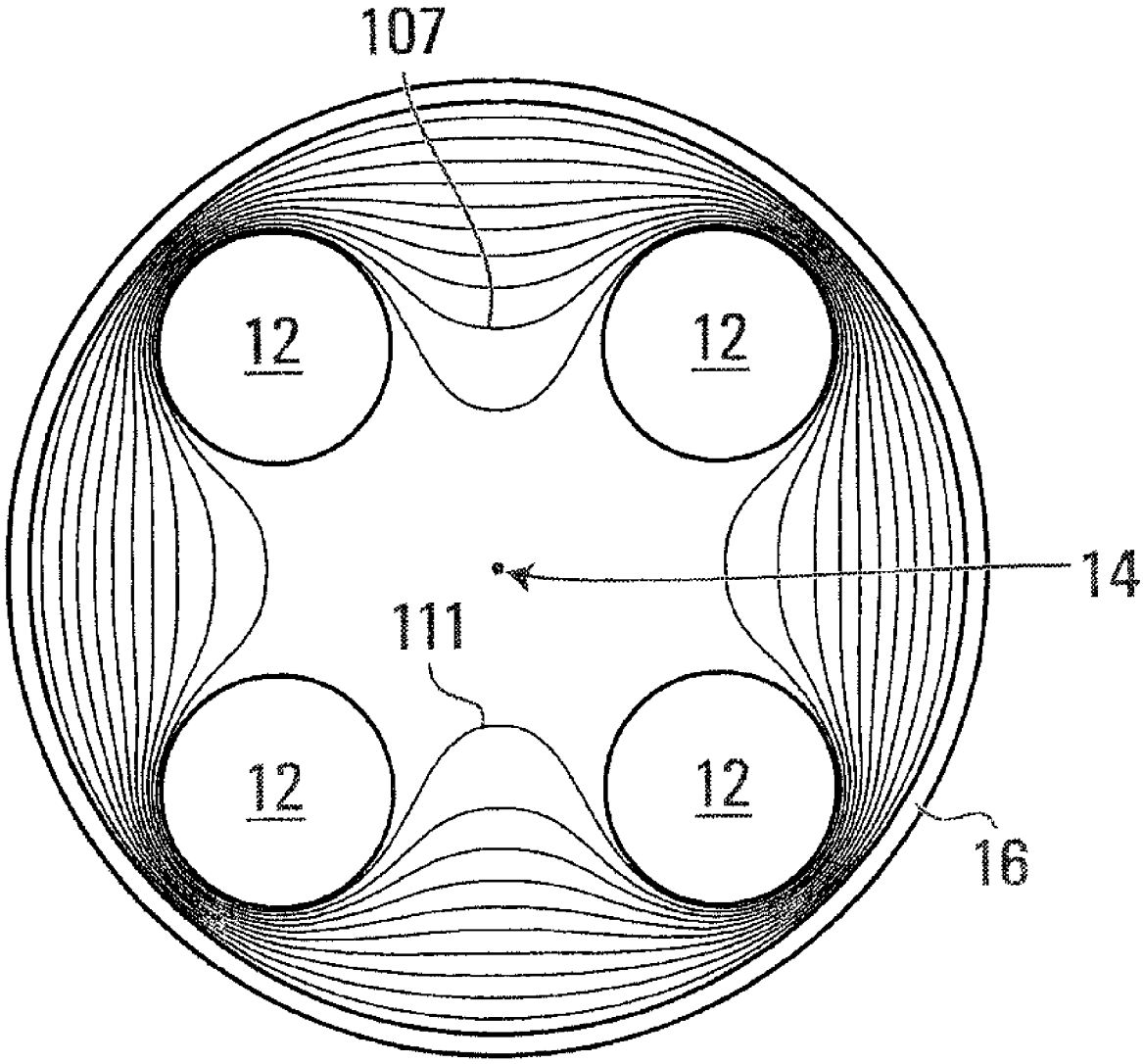
FIGS. 4A, and 4B and illustrate example equipotential lines in an ion guide, like the ion guide of FIG. 1.
Figure 4B:
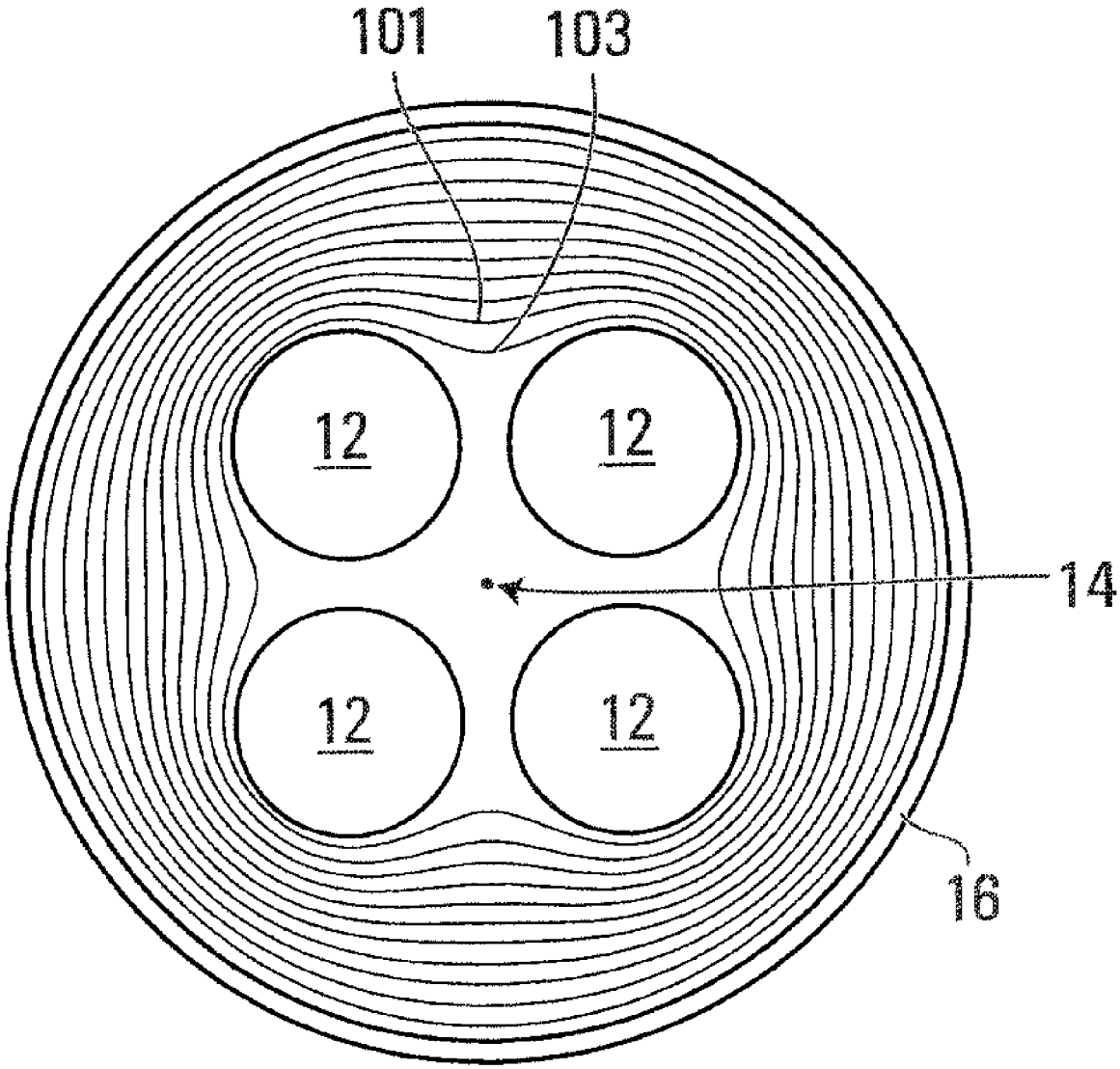

The effect of the geometry on the voltage combination of rods 12 and casing 16, at axis 14 is illustrated by way of example, in FIGS. 4A and 4B. More specifically, FIGS. 4A and 4B qualitatively depict cross sections of ion guide 10 and casing 16 at two positions along the axis 14, with simulated equipotential lines interior to casing 16. These equipotential lines reflect the voltages that result from the combination of a DC voltage applied to rods 12 ($U_{DC}$) and casing 16 ($U_{CASE}$). Any field attributable to RF voltage $V_{AC}$ applied to rods 12 is not depicted.

In the examples of FIGS. 4A and 4B, $U_{CASE}$ is set to +100V and $U_{DC}$ is set to −60V. Cylindrical casing 16 has a 44 mm diameter (with a surface of casing 16 spaced 22 mm from axis 14). Rods 12 may each have 11 mm diameters, and may be about 200 mm long. Rods 12 may be spaced symmetrically about axis 14. The distance $x_i$ between rods 12 proximate aperture 19*a* is 6 mm and proximate aperture 19*b* is 3 mm. With voltage on casing 16 of +100V and rods 12 of −60V, it is estimated that the potential on axis 14 is approximately −58.5V proximate aperture 19*a* and −60V proximate aperture 19*b*.

As illustrated, where the spacing is relatively large, as shown in FIG. 4A, the equipotential surfaces 107, 111 and near axis 14 are −32V, −45V, and −58.5V. The voltage at a corresponding position on axis 14 is due to a larger fraction of the voltage applied to casing 16 combined with rods 12.

By contrast, where rods 12 are closely spaced, as shown in FIG. 4B, the voltage is calculated at surfaces 101, 103 and near axis 14 as −30V, −44V and −59.96V, respectively, are farther from axis 14 than corresponding surfaces in FIG. 4A. As should be apparent, the voltage proximate axis 14, at a corresponding position along the lengths of rods 12 is now almost entirely attributed to $U_{DC}$ applied to rods 12.

As will now be appreciated, under these conditions a positive ion will be subject to −58.5 V proximate aperture 19*a* (acting as inlet) and will be accelerated by the 1.5V potential difference between −58.5V proximate aperture 19*a* at −60V proximate aperture 19*b* (acting as outlet), along axis 14. The resulting axial field is about 1.5V/200 mm. If the initial reference voltage of incoming ions is −10V, it establishes an initial energy of about 48.5 eV near aperture 19*a*. Fragment ions will then be accelerated by the roughly 1.5V potential difference between −58.5V proximate aperture 19*a* at −60V proximate aperture 19*b*, along axis 14. The ion will not pick up 1.5V energy because it is a collision-rich environment.

Of interest, the electric field attributable to four rods 12, in the region contained between rods 12 and axis 14 in FIG. 4A is generally hyperbolic. As the distance between rods, $x_i$ is increased and the rods are displaced further, as illustrated in FIG. 4A, the field takes on multipolar characteristics, for example resembling an octopolar field, mixed with other multipolar components.

As further example, if the distance between rods 12 proximate aperture 19*a* (acting as outlet) is 3 mm and proximate aperture 19*b* (acting as inlet) is 6 mm with a DC voltage on casing 16 of −100V and rods 12 of −60V, it is estimated that the potential on axis 14 is approximately −60V at the entrance and −61V at the exit. Under these conditions a positive ion will be subject to a −60V potential at the entrance and will be accelerated by the 1V potential difference between the entrance and the −61V exit. Again the ion will not pick up 1V energy because it is a collision-rich environment, but does pick up, on average, a small portion of it.

Figure 5:
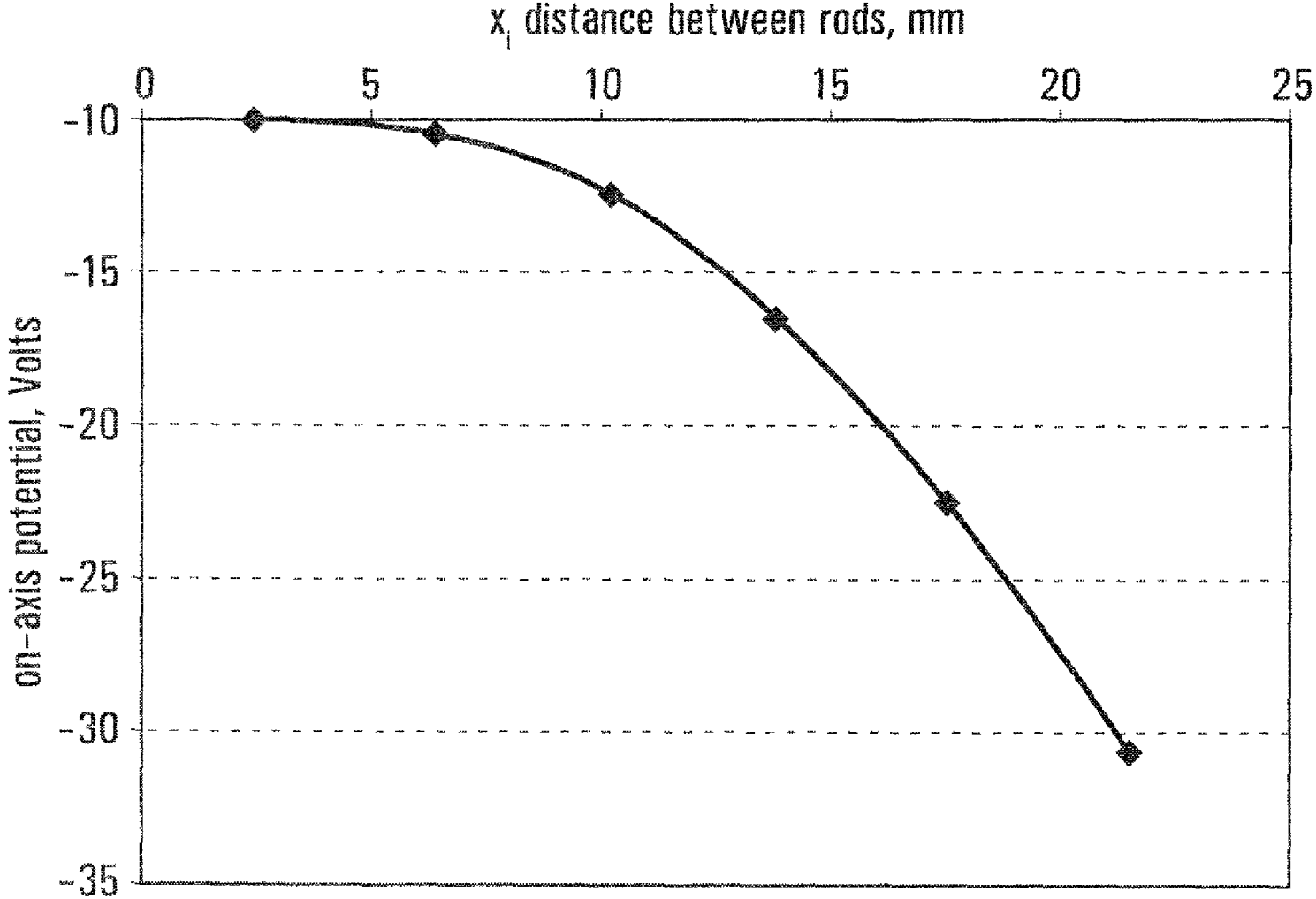
FIG. 5 is a graph of example calculated potentials along a central axis of an ion guide like the ion guide of FIG. 1.

Similarly, FIG. 5 displays a calculated voltage along axis 14 of an ion guide, like ion guide 10, as a function of distance $x_i$ between rods 12. For illustration, calculations are performed for an ion guide where rods 12 have a 9 mm diameter, and casing 16 is positioned about 30 mm from axis 14. Here, the rod offset voltage ($U_{DC}$) is −10V and the voltage on the casing −100V. Where the distance $x_i$ between rods 12 is small, there is little or no effect of the field produced by the casing and the voltage on-axis 14 is determined predominantly by the rod offset voltage $U_{DC}$. The on-axis voltage becomes more negative as the spacing between the rods 12 increases while the diameter of the casing 16 remains the same. Where the spacing between rods is large, the voltage on axis 14 is determined by combination of the voltage on casing 16 and the rod offset voltage $U_{DC}$. Thus, when $x_i$ is small, the voltage on axis is primarily $U_{DC}$. When $x_i$ is large, substantial contribution from casing 16 is possible.

Conveniently, casing 16 serves several purposes: it contains the gas used to in ion guide 10, while also providing the axial field used to guide ions along axis 14. Further, it is relatively easy to fabricate, and only a single additional DC voltage source is needed to generate an axial field.

Often, in use as a collision cell, the energy of incoming ions may be varied in a deterministic fashion to increase fragmentation efficiency. As such, the voltage $U_{DC}$ on rods 12 may optionally be varied with incoming ions. It may also be desirable to maintain a fixed axial field along axis 14 for the collision cell, for all ions. As the axial field is determined by $U_{CASE}$ and $U_{DC}$, $U_{CASE}$ may therefore be selected depending on the applied $U_{DC}$. In a simple case such as shown in FIG. 1 the relationship may be approximated as linear. For example, to yield an axial field of 1.5V/mm, with $U_{DC}$=0V, −30V, and −60V requires $U_{CASE}$=160V, 130V, and 100V, respectively. As desired, casing voltage $U_{CASE}$ may be varied with $U_{DC}$ automatically under software or hardware control.

As will now be appreciated, ion guide 10 need not be formed with rods 12 arranged in quadrupole. Instead, any suitable number of rods could be arranged in multipole (with suitable tilt) about axis 14. For example, three, four, five or more poles could be arranged: four in quadrupole; six in hexapole; eight in octopole; ten in dodecapole and the like. Supply 30 would provide appropriate voltages to the multipole arrangement of rods.

Similarly, other rod and casing geometries are possible. For example, rods 12 need not have uniform cross-sections, but could be tapered with larger cross-sectional surface areas proximate the collision cell entrance than exit. Conveniently, rods may thus be arranged so that the distance between adjacent rods changes, while the distance between opposing rod centers remains constant. Again, the contribution of $U_{CASE}$ on casing 16 on axis 14 is greater as adjacent rods are farther apart, and less where adjacent rods are closer together. Again, this results in an axial field.

Likewise, casing 16 need not be cylindrical. Depending on the inward field pattern resulting from an applied voltage on the casing, rods 12 may be arranged accordingly. For example, casing 16 could be generally frustoconical (e.g. of the form of a truncated cone). The field strength at the same distance from axis 14 would therefore be different along the length of axis 14. As a result, parallel rods in combination with such a casing, would result in an axial field. Again, for constant $U_{DC}$ and $U_{CASE}$, the voltage along axis 14 decreases as casing diameter 16 decreases Other rod/casing geometries should now be apparent to those of ordinary skill. For example, a tilted casing combined with tilted and/or straight rods may result in a desired axial field.

Rods 12 also need not have circular cross-sections, but could instead have hyperbolic cross sections, oval cross sections, square or rectangular cross sections, or other suitable cross sections. Again, rods may be tilted to vary their spacing and the degree of penetration attributable to casing 16. Optionally, the ratio of diameter of rods 12 to circumscribed circle d may be held constant along the length, in order to provide a constant multipolar field inside rods 12, as for example detailed in U.S. patent application Ser. No. 11/331,153, the contents of which are hereby incorporated by reference. Rods 12 may be smooth or they may have stepped sections along the length.

Rods 12, however, need not be tilted, but may be segmented (with each rod 12 formed by multiple rod segments, extending lengthwise along guide 10), tapered and/or have varying cross-section along their length, in order to achieve a suitable axial field. They may be smooth or they may have stepped sections along the length. In particular, rods with a generally rectangular cross-section are easy to manufacture and assemble, and therefore reduce cost.

Figure 6A:
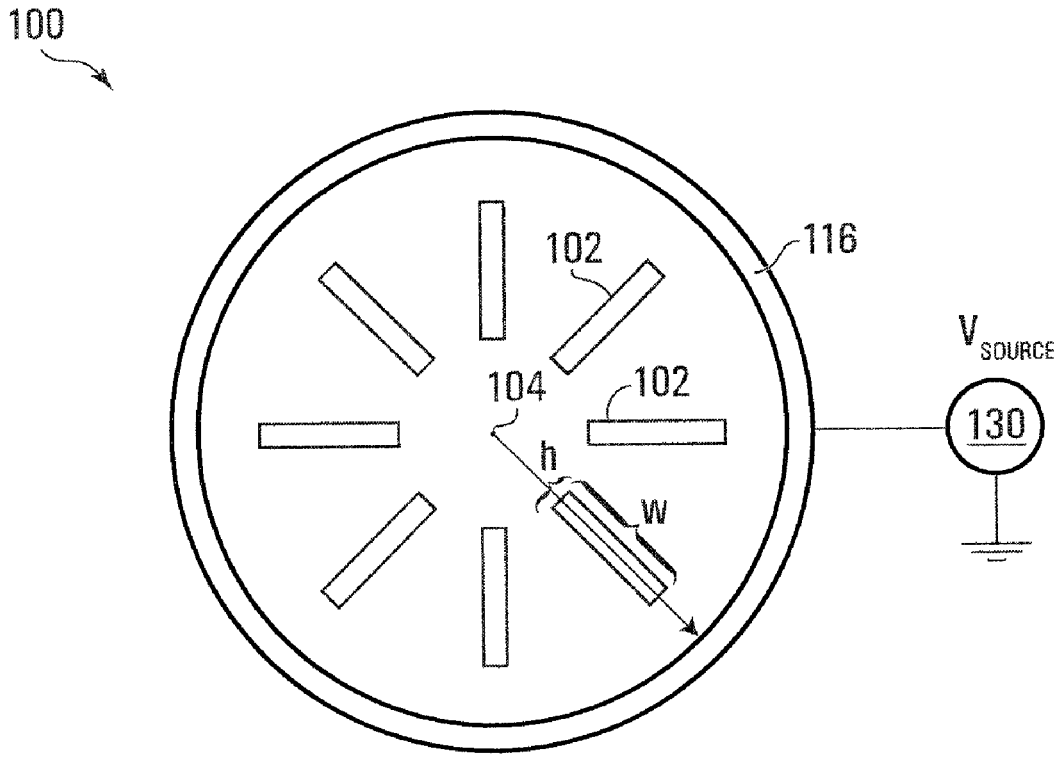
FIG. 6A is an end view of a further ion guide, exemplary of another embodiment of the present invention.
Figure 6B:
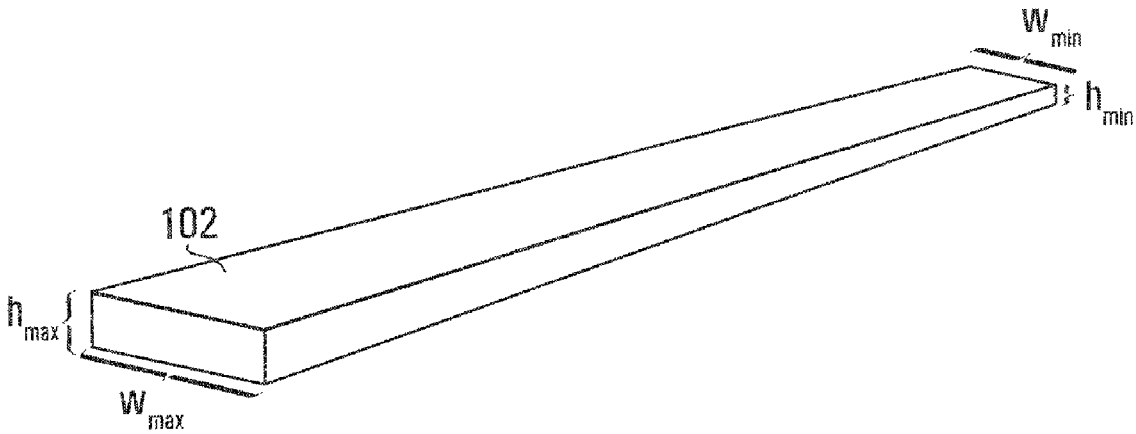
FIG. 6B is a three-dimensional schematic diagram of rods used in the ion guide of FIG. 6A.
Figure 6C:
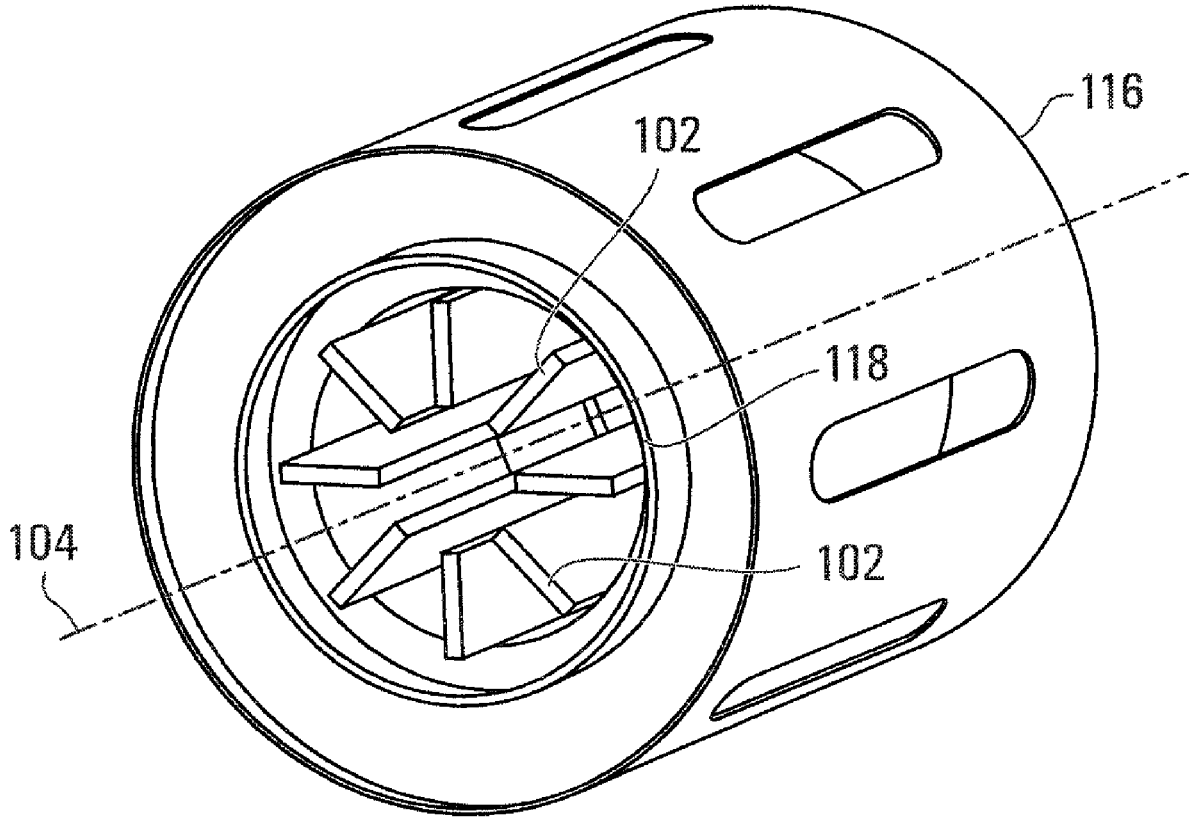
FIG. 6C is a three-dimensional schematic view of the ion guide FIG. 6A.

To this end, FIGS. 6A, 6B and 6C illustrate the electrode arrangement of an alternate ion guide 100. Here rods 102 have a generally rectangular cross-section as more particularly illustrated in FIG. 6B, and are arranged about axis 104 within a cylindrical casing 116. At each point along the length of the rod, each rod has width $w_i$ and height $h_i$. Rods 102 may be machined as shims: to have one lengthwise extending edge tapered, such that $h_i$ or $w_i$ varies from $h_{max}$ to $h_{min}$ (or $w_{max}$ to $w_{min}$) along the length of each rod 102, as illustrated in FIG. 6B. As illustrated in FIGS. 6A and 6C, rods 102 are mounted in casing 116 with their width ($w_i$) extending radially from axis 104, and their non-tapered edges extending parallel to each other. Width $w_i$ decreases along the length of rods 102. As a result, the distance between the geometric cross-sectional centers of opposing rods 102 increases, and the containment region between the rods 102 increases. At the same time, the effective spacing of the rods increases 102, as the cross-sectional area of the rods 102 decreases, allowing greater field penetration from casing 116 along the length of axis 104. Again, rods 102 could be segmented, or have varying cross-sections along their length.

A power supply 130 applies an AC (RF) voltage of opposite phase applied to adjacent ones of rods 102. A rod offset voltage $U_{DC}$ is also applied to all rods 102, while a separate DC voltage is applied to casing 116. An insulating ring 118 (FIG. 6C) separates rods 102 from casing 116. Casing 116 in combination with tapered rods 102 provides an axial field along axis 104, in the same way as casing 16 provides an axial field along axis 14. As well, casing 116 restricts pumping, sometimes helpful to prevent scattering losses. Casing 116 is however open at both ends, providing an ion entrance and the exit.

In an example embodiment, rods 102 may be tapered along their length such that one end is 3 mm high ($h_{max}$) by 12 mm ($w_{max}$) wide and the other is 3 mm ($h_{min}$) wide by 9.75 mm high ($w_{min}$). Rods 102 extend about 130 mm along axis 104, and the diameter of casing 116 is about 75 mm. In this example, the larger spacing is at the entrance and the smaller spacing is at the exit. With a rod offset voltage, $U_{DC}$, of −20V, and a casing voltage of about +100V, the effective voltage at the entrance is about −19.8V and at the exit is about −20V, giving about 1 mV/mm axial field along the length. A configuration where the ends are open may be particularly suitable as an ion guide in high pressure regions.

Rectangular rods 102 may, of course, be designed so that the height, rather than the width, varies along the length, or both may vary along the length. Rectangular rods 102 could similarly be tilted. Other configurations of rods 102 and casing 116 may similarly be combined to form axial field along the length of the ion guide 100.

Figure 7A:
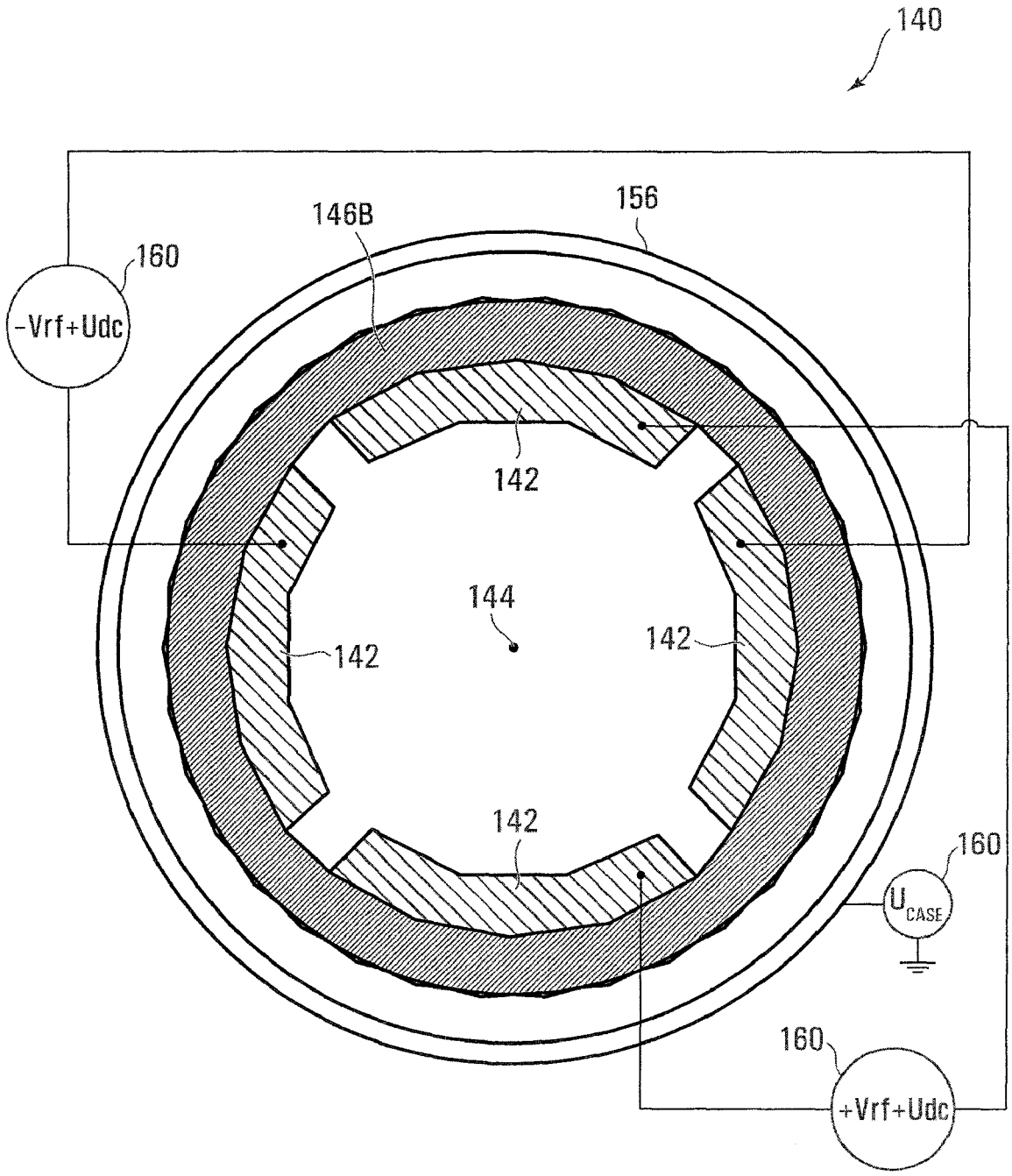
FIG. 7A is an end view of a further ion guide, exemplary of an embodiment of the present invention.
Figure 7B:
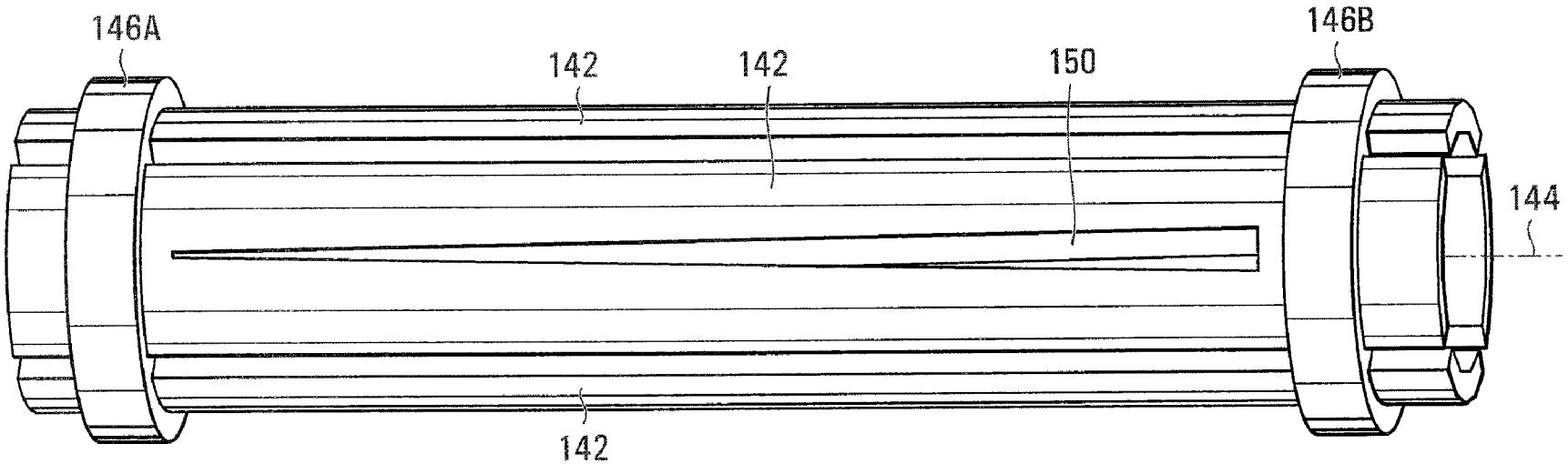
FIG. 7B is a three-dimensional schematic diagram of rods used in the ion guide of FIG. 7A.

A further alternate ion guide 140 is illustrated in FIGS. 7A and 7B. Ion guide 140 includes a plurality of rods 142, with each rod 142 formed as a cylindrical conductive wall section, each including a tapered slot 150. Rods 142 are arranged about the circumference of a cylinder that extends lengthwise along axis 144, within a generally cylindrical casing 156. Each wall section may be considered as the portion of a hollow cylinder cut by a plane through axis 144. Each wall section thus subtends an angle about axis 144. In the depicted embodiment, ion guide 140 includes four rods 142, each formed as a cylindrical wall section subtending an angle of about 90° about axis 144. Conveniently, rods 142 may be manufactured by slicing a conductive cylinder lengthwise, and stamping slots 150. Rods 142 are spaced from each other and casing 156, and may be maintained in position relative to each other by retaining rings 146*a* and 146*b*. The tapered slot 150 in each rod 142 is generally triangular formed in each rod 142, and extends from a thin end to a wider end, widening along the length of each rod 142, generally parallel to axis 144. As will be appreciated, tapered slots may be used in any type of rod of various geometries such as straight rods, or rods of circular, rectangular, oval, hyperbolic or other cross section, and the like.

A power supply 160 applies an AC (RF) voltage of opposite phase applied to adjacent ones of rods 142. A rod offset voltage $U_{DC}$ is also applied to all rods 142, while a separate DC voltage is applied to casing 156. Retaining rings 146*a*, 146*b* (FIG. 7B) separates rods 142 from casing 156. The DC voltage at a point on axis 144 is attributable to the DC voltage applied to casing 156 and rods 142. The voltage attributable to casing 156 is greater at points along axis 144, where slots 150 are the widest. As slots 150 narrow, the voltage on axis 144 attributable to casing 156 decreases, while the voltage attributable to the DC voltage on rods 142 increases. Casing 156 in combination with rods 142 thus also provides an axial field along axis 144. Casing 156 is again open at both ends, providing an ion entrance and the exit for ion guide 140.

As will now be appreciated, an axial field may be created using a variety of case and rod geometries. For example a similar voltage gradient may be produced using round or rectangular rods that are arranged in parallel, but contain tapered slots to permit the electric field from the casing to contribute to the voltage on axis.

Conveniently, an axial field may also provide may better control of ion motion For example ions can be trapped within ion guide 10 by oscillating the polarity of the axial field, by for example changing the applied polarity every few milliseconds in a several hundred millimetre long ion guide.

In the above described embodiments, voltage source 30/130/160 applies a DC voltage to casing 16/116/156. However, voltage source 30/130/160 could be replaced with a time varying voltage source, having a DC component, or a substantially DC voltage, such as a low (e.g. 1-1 kHZ) frequency sine or square wave. For example, the time varying voltage source could apply a DC voltage intermittently, or a voltage having a periodic shape (e.g. sinusoidal, triangular, square or the like). For example, a time-varying sinusoidal voltage applied to casing 16 may produce a slowly varying axial field, sweeping ions along axis 14 or 104 back and forth in the direction of the axial field. Such a field could help to decluster ions, fragment weakly bound ions, or separate ions on the basis of their mobility.

Likewise, a resolving DC potential could be applied to rods 12/112/142. For example, an additional $+U_{RESOLVE}$, and $-U_{RESOLVE}$ could be applied to adjacent rod pairs within ion guides 10/100/140. Further, auxiliary excitation voltages (e.g. quadrupolar or dipolar excitation) could be applied. Similarly, a DC and RF field could be superimposed on the casing.

Figure 8A:
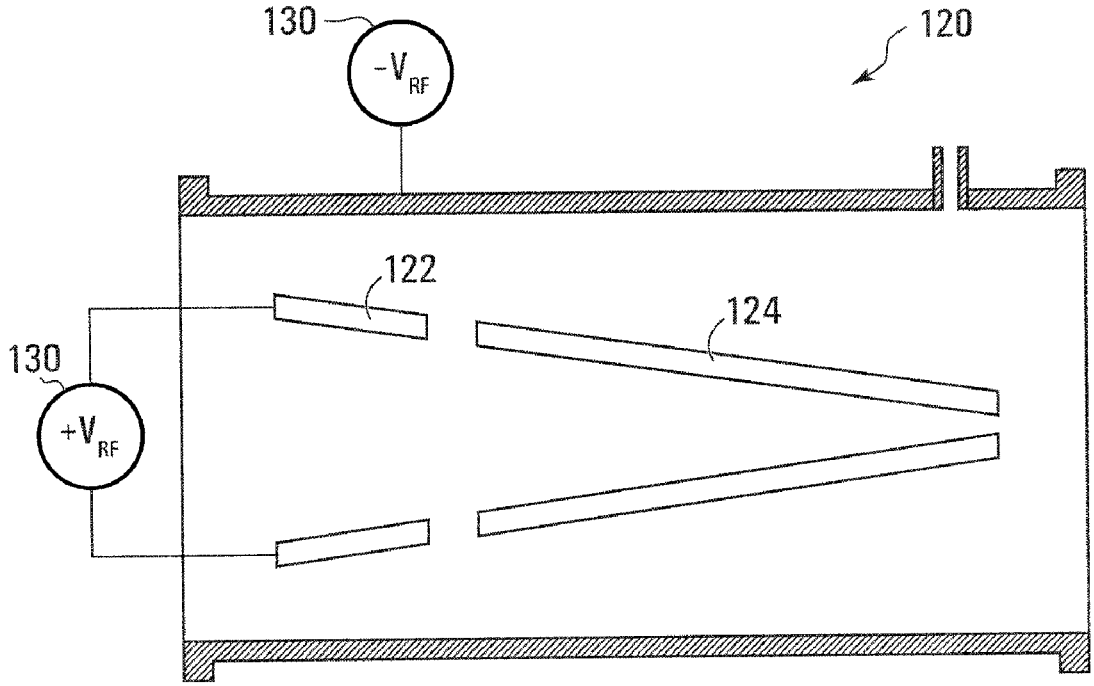
FIGS. 8A and 8B are simplified schematic diagrams of a further ion guide, exemplary of another embodiment of the present invention.
Figure 8B:
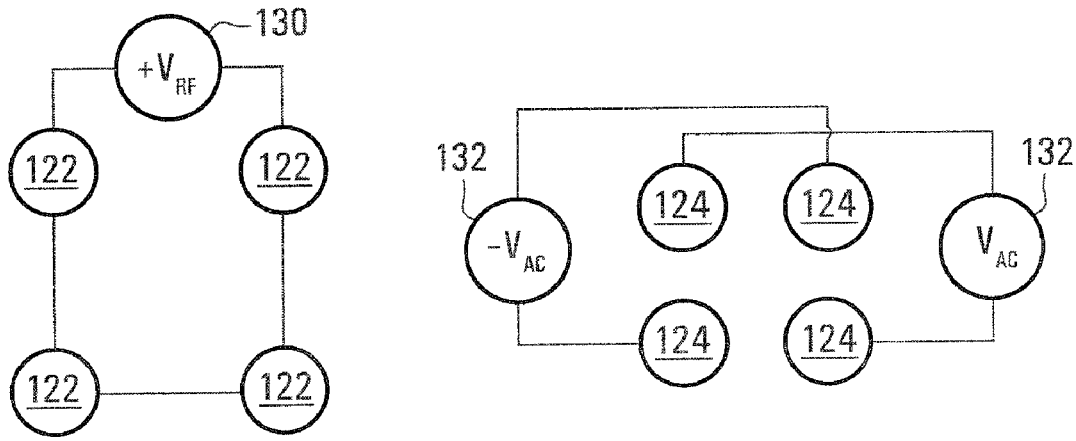

FIGS. 8A and 8B illustrate a further ion guide 120, including two rodset segments 122 and 124 in a casing 126. Each of rodsets 122 and 124 are formed of tilted rods, of uniform cross section, arranged in quadrupole, or as otherwise described above. A voltage source 130 applies a time varying AC voltage to casing 126. Similarly, voltage sources 130 and 132 provide time varying AC voltages to rodsets 122 and 124 as schematically illustrated in FIG. 8B, respectively. Rodset 122 is proximate the inlet of ion guide 120 and has a sufficiently large spacing such that there is substantial contribution attributable the voltage applied to casing 126. Segments are connected together by supply 130 providing a single AC voltage. As ions enter rodset segment 122 they experience an effective containment area at the entrance, as provided by generally multipolar field at the entrance, providing effective collection of ions at the entrance. An additional AC voltage is applied to casing 132. Rods in second rodset segment 124 are sufficiently close that the field penetration from casing 126 is much weaker. The two rod pairs of rodset 124 are connected to opposite phases of voltage source 132. Further, as ions enter rodset segment 124, the containment field may be smaller, and ions may be more focused at the exit of rodset segment 124.

As will also be appreciated, if rods are segmented different DC offset voltages ($U_{DC}$) may be applied to each rodset segment forming a rod, effectively allowing ions to be accelerated between segments.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

What is claimed is:

1. An ion guide comprising:

a plurality of parallel rods, arranged in multipole about an axis that extends lengthwise from a first end to a second end of said ion guide, to guide ions in a guide region along and about said axis;

wherein each of said plurality of rods has a generally rectangular cross-section and is tapered along its length;

a conductive cylindrical casing surrounding said plurality of rods;

at least one voltage source, interconnected to said plurality of rods and to said casing to produce an axial electric field along said axis.

2. The ion guide of claim 1, wherein said at least one voltage source provides a time varying voltage to said conductive casing.

3. The ion guide of claim 1, wherein said at least one voltage source provides a DC voltage to said conductive casing to produce said field.

4. The ion guide of claim 1, wherein each of said rods comprises a plurality of rod segments.

5. An ion guide comprising:

a plurality of parallel rods, arranged about an axis that extends lengthwise from a first end to a second end of said ion guide, to guide ions in a guide region along and about said axis;

a conductive cylindrical casing surrounding said plurality of rods;

wherein each of said plurality of rods has a generally rectangular cross-section and is tapered along its length;

wherein said casing and said plurality of rods are geometrically arranged so that a first constant applied DC voltage ($U_{DC}$) applied to said rods, and a second constant applied DC voltage ($U_{CASE}$) applied to said conductive casing, produce a voltage gradient between said casing and said axis that has a different magnitude at different positions along said axis, to produce an axial electric field along said axis.

6. The ion guide of claim 5, maintained at a pressure between about $10^{-4}$ and $10^{-2}$ Torr.

7. The ion guide of claim 5, maintained at a pressure between about $10^{-4}$ and 10 Torr.

8. The ion guide of claim 5, wherein four rods are arranged in quadrupole about said axis.

9. The ion guide of claim 5, wherein six rods are arranged in hexapole about said axis.

10. The ion guide of claim 5, wherein said rods are formed as shims.

11. The ion guide of claim 5, wherein said conductive casing has a conductive inner surface.

12. The ion guide of claim 5, wherein said conductive casing comprises a focusing lens at each end, to allow said on guide to function as a collision cell.

13. The ion guide of claim 5, wherein eight rods are arranged in octopole about said axis.

14. A mass spectrometer comprising the ion guide of claim 5.

15. A method comprising:

providing a plurality of parallel rods about an axis that extends lengthwise from a first end to a second end to guide ions in a guide region along and about said axis;

providing a conductive cylindrical casing surrounding said plurality of rods;

creating a multipolar electric field between said plurality of rods to contain ions in said guide region;

applying a substantially DC voltage to said conductive casing and said rods, wherein each of said plurality of rods has a generally rectangular cross-section and is tapered along its length;

wherein said casing and said plurality of rods are geometrically arranged so that said substantially DC voltage to said casing and said rods, produce a voltage gradient between said casing and said axis that has a different magnitude at different positions along said axis, to produce an axial electric field along said axis.

16. The method of claim 15, wherein said providing comprises providing four rods about said axis.

17. The method of claim 15, wherein said creating a multipolar electric field between said plurality of rods comprises applying a sinusoidal voltage across opposite ones of said plurality of rods.

18. The method of claim 15, further comprising adjusting said substantially DC voltage applied to said rods and said casing, in dependence on ions to be guided by said rods, in order to assist in fragmentation of said ions.

19. The method of claim 15, wherein said at least one voltage source applies a different DC voltages to different rod segments forming one of said rods.

20. The ion guide of claim 5, wherein each of said rods has a straight edge, parallel to said axis.

21. The ion guide of claim 5, wherein each of said plurality of rods has two parallel edges parallel to said axis, and wherein the width of each of said plurality of rods extends radially relative to said axis, and the width of each of said rods is tapered along its length.

22. The ion guide of claim 5, wherein each of said plurality of rods has a width and a height, and wherein the height of each of said plurality of rods is constant along its length.

23. An ion guide comprising:

a plurality of parallel rods, arranged in multipole about an axis that extends lengthwise from a first end to a second end of said ion guide to guide ions in a guide region along and about said axis;

wherein each of said plurality of rods is oriented parallel to said axis, and has a slot extending along its length, and wherein the size of each slot varies along its lengthwise extent;

a conductive cylindrical casing surrounding said plurality of rods;

at least one voltage source, interconnected to said plurality of rods and to said casing to produce an axial electric field along said axis.

24. The ion guide of claim 23, wherein each of said slots is tapered along its lengthwise extent.

25. The ion guide of claim 24, wherein each of said slots is narrower proximate said first end than said second end.

* * * * *

UNITED STATES PATENT AND TRADEMARK OFFICE

CERTIFICATE OF CORRECTION

PATENT NO. : 7,868,289 B2
APPLICATION NO. : 11/742203
DATED : January 11, 2011
INVENTOR(S) : Lisa Cousins et al.

It is certified that error appears in the above-identified patent and that said Letters Patent is hereby corrected as shown below:

Claim 12 - column 11, line 24: “on” should read “ion”

Signed and Sealed this
Seventh Day of June, 2011

David J. Kappos

David J. Kappos
*Director of the United States Patent and Trademark Office*